US011333004B2

(12) United States Patent
Taylor, Jr. et al.

(10) Patent No.: US 11,333,004 B2
(45) Date of Patent: May 17, 2022

(54) PISTON INITIATOR FOR SIDETRACK ASSEMBLY

(71) Applicant: Weatherford Technology Holdings, LLC, Houston, TX (US)

(72) Inventors: James H. Taylor, Jr., Houston, TX (US); Ronald G. Schmidt, Tomball, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/891,276

(22) Filed: Jun. 3, 2020

(65) Prior Publication Data

US 2021/0381339 A1 Dec. 9, 2021

(51) Int. Cl.

| | |
|---|---|
| ***E21B 34/14*** | (2006.01) |
| ***E21B 29/00*** | (2006.01) |
| ***E21B 29/06*** | (2006.01) |
| ***E21B 34/06*** | (2006.01) |
| *E21B 23/01* | (2006.01) |
| *E21B 33/12* | (2006.01) |
| *E21B 41/00* | (2006.01) |

(52) U.S. Cl.

CPC ..... *E21B 34/14* (2013.01); *E21B 29/002* (2013.01); *E21B 29/06* (2013.01); *E21B 34/063* (2013.01); *E21B 23/01* (2013.01); *E21B 33/12* (2013.01); *E21B 41/0078* (2013.01); *E21B 2200/06* (2020.05)

(58) Field of Classification Search

CPC ..... E21B 29/00; E21B 29/002; E21B 29/06; E21B 34/14

See application file for complete search history.

(56) References Cited

U.S. PATENT DOCUMENTS

| | | | |
|---|---|---|---|
| 5,341,873 | A | 8/1994 | Carter et al. |
| 5,409,060 | A | 4/1995 | Carter |
| 5,425,417 | A | 6/1995 | Carter |

(Continued)

FOREIGN PATENT DOCUMENTS

| | | | |
|---|---|---|---|
| EP | 0846837 | A2 | 6/1998 |

OTHER PUBLICATIONS

Weatherford, "HyperLine Mud-Lubricated Motor with Motor Lock Assembly," www.weatherford.com, 2013, 2 pages.

(Continued)

*Primary Examiner* — Blake Michener
*Assistant Examiner* — Theodore N Yao
(74) *Attorney, Agent, or Firm* — Blank Rome LLP

(57) ABSTRACT

A piston initiator is used on an assembly having a milling tool and a whipstock for creating a sidetrack in a wellbore. A piston disposed in an uphole position in a bore of the milling tool seals the bore from communicating with the port. A line from the port can communicate pressure to components on the whipstock for initiating their activation. The piston is movable from the uphole position, but is held by a releasable connection configured to release the piston in response to a predetermined force from fluid flow in a downhole direction against an exposed surface area of the piston. An uphole shoulder in the milling tool prevents movement of the piston in an uphole direction so the piston does not stress the releasable connection in response to reverse fluid flow through the milling tool.

19 Claims, 8 Drawing Sheets

(56) References Cited

U.S. PATENT DOCUMENTS

| | | | | |
|---|---|---|---|---|
| 5,429,187 | A | 7/1995 | Beagrie et al. | |
| 5,452,759 | A | 9/1995 | Carter et al. | |
| 5,584,350 | A | 12/1996 | Schnitker et al. | |
| 5,720,349 | A | 2/1998 | Pleasants et al. | |
| 5,771,972 | A * | 6/1998 | Dewey | E21B 29/06 166/298 |
| 6,105,675 | A | 8/2000 | Buytaert et al. | |
| 6,364,037 | B1 * | 4/2002 | Brunnert | E21B 7/061 175/61 |
| 6,550,551 | B2 | 4/2003 | Brunnert et al. | |
| 6,695,056 | B2 | 2/2004 | Haugen et al. | |
| 6,719,045 | B2 | 4/2004 | Hart et al. | |
| 7,077,212 | B2 * | 7/2006 | Roesner | E21B 23/06 166/382 |
| 8,991,489 | B2 | 3/2015 | Redlinger et al. | |
| 10,006,264 | B2 | 6/2018 | Glaser et al. | |
| 2009/0056952 | A1 * | 3/2009 | Churchill | E21B 34/14 166/373 |
| 2014/0110129 | A1 | 4/2014 | Schmidt | |
| 2016/0348456 | A1 * | 12/2016 | LaPlante | E21B 29/06 |
| 2018/0320448 | A1 | 11/2018 | Hern et al. | |
| 2019/0316435 | A1 | 10/2019 | Taylor, Jr. | |
| 2020/0040683 | A1 | 2/2020 | Taylor, Jr. et al. | |
| 2020/0087987 | A1 | 3/2020 | Campbell et al. | |
| 2020/0224504 | A1 * | 7/2020 | Ruttley | E21B 17/02 |

OTHER PUBLICATIONS

Weatherford, "OneTrip StarBurst Level 4 Multilateral-System," www.weatherford.com, 2006-2007, 4 pages.

Weatherford, "QuickCut Casing Exit System—A Cut Above," brochure 465.00, 2005, 4 pages.

Weatherford, "QuickCut MillBit Assembly," www.weatherford.com, 2018, 2 pages.

Weatherford, "QuickCut Casing-Exit System RMN- and RHN-Type Anchors," www.weatherford.com, 2019, 6 pages.

Weatherford, "Shallow-Angle QuickCut Casing Exit System—PHS Type Anchor," www.weatherford.com, 2008, 3 pages.

Weatherford, "Shallow-Angle QuickCut Casing Exit System—RHS Type Anchor," www.weatherford.com, 2008-2011, 4 pages.

International Search Report dated Aug. 11, 2021 and issued in counterpart International PCT application No. PCT/US2021/030470.

* cited by examiner

PISTON INITIATOR FOR SIDETRACK ASSEMBLY

BACKGROUND OF THE DISCLOSURE

For various reasons, operators may want to cut into the side of casing in an existing wellbore so a new sidetracked or lateral wellbore can be drilled. For example, the formation adjacent the original wellbore may become depleted or damaged, or a tool or pipe may have become stuck and may have blocked further use of the original wellbore. For whatever reason, the sidetracked wellbore can be drilled and then lined with pipe for additional operational uses.

To drill the sidetrack, a whipstock can be used for diverting a milling tool to create the sidetracked wellbore. Operators run the whipstock down the original wellbore's casing to a desired depth. The whipstock, which has a wedge-shaped member or whip with a concave face, can then steer the mill to the side of the casing where a window will be formed.

The whipstock may be run in by itself on a setting tool, and the mill can be run in after the whipstock has been set. Alternatively, to save a trip, the milling tool is run in with the whipstock temporarily attached to the mill so the assembly can be run in together. When the desired depth is reached, a packer and an anchor on the whipstock are set in the casing. Various types of anchors and packers can be used with the whipstock, and they can be set mechanically or hydraulically.

With the whipstock set, the mill of the milling tool is disengaged from the whipstock, and the mill uses the incline of the whipstock to drill the window in the casing for starting the sidetrack wellbore. In the process, the anchor keeps the whipstock in place to resist the downward force placed upon it as the mill moves along its length through the wall of the casing.

When the milling tool is run in with the whipstock assembly, activation of the whipstock's packer and anchor must be achieved across their interconnection. One way to do this is to have an activation device on the milling tool communicate hydraulic pressure via a pressure line to the whipstock assembly to set the packer and anchor.

For example, FIGS. 1A-1B illustrate one type of activation device 10 of the prior art for a milling tool 14. The activation device 10 is that disclosed in U.S. Pat. Nos. 6,364,037 and 6,550,551, which are incorporated herein by reference in its entirety. The device 10 has a tubular member 12, which has a window mill 14 including a plurality of cutters 16 and flow ports 17. An end of a whipstock 20 is connected the mill 14 at a fixture 25. As noted above, hydraulic communication from the milling tool 14 to the whipstock 20 may be used to set a packer and an anchor of the assembly. When run in as shown in FIG. 1A, the activation device 10 is unactivated. When the assembly has reached depth, the activation device 10 is then activated to open hydraulic communication to the packer and anchor of the assembly.

To do this, the activation device 10 includes a moveable sleeve 30. In the unactuated position illustrated in FIG. 1A, the moveable sleeve 30 is attached to an upper stationary portion 34 with a shearable connection 36, which comprises at least one shearable member constructed and arranged to fail upon application of a certain force thereto. The force exerted upon the shearable connection 36 is determined by the flow rate and pressure of fluid through activation device 10.

The moveable sleeve 30 includes a restriction 32 in the inner diameter thereof that serves to restrict the flow of fluid through the device's tubular member 12. As fluid passes through the activation device 10 and encounters the restriction 32, the pressure of the fluid drops in a region 15 directly below the restriction 32 and increases in a region 35 directly above the restriction 32, thereby creating a pressure differential between the two regions 15, 35. Conversely, the velocity of the fluid decreases in the upper region 35 and increases in the lower region 15. Formed in a wall of the tubular member 12 is a pressure port 18. Connected in fluid communication to the pressure port 18 through a fitting 22 is a pressure sensing line 24.

As depicted in FIG. 1A, when the activation device 10 is in its unactuated state, the pressure sensing line 24 is in communication with the lower pressure region 15 on the downhole side of the restriction 32 because the port 18 is not sealed to the lower pressure region 15. To actuate the activation device 10, fluid at a predetermined flow rate is applied through the tubular member 12. As the fluid moves through the restriction 30, pressure rises in the upper region 35. A certain flow rate will produce a force at the restriction 32 corresponding to the pressure differential and adequate to overcome the shear strength of the shearable members making up the shearable connection 36. Thereafter, the moveable sleeve 30 moves into the position illustrated in FIG. 1B.

As shown in FIG. 1B, in its actuated position, the activation device 10 places the pressure sensing line 24 in fluid communication with the upper region 35 of tubular member 12 above the restriction 32. In this way, the pressure sensing line 24 is exposed to the higher pressure created by the flow of fluid through the restriction 32. In turn, the pressure sensing line 24 transmits this increased pressure to the packer and anchor of the assembly, as noted above.

FIG. 2 is a cross-sectional view illustrating another activation device 10 of the prior art for use with a sidetrack system. This device 10 corresponds to that disclosed in U.S. Pat. No. 7,077,212, which is incorporated herein by reference in its entirety. The device 10 has a tubular member 12, which has a window mill 14 including a plurality of cutters 16 and flow ports 17. As shown, a sand tube 40 is disposed in the tubular member 12 and is secured in place by a set screw 41. The sand tube 40 acts as a sand screen to prevent sand from clogging up a pressure port 18 formed in the tubular member 12. The sand tube 40 includes a slit 46 located in an upper region 44 to communicate a change in pressure through an annular area 48 and subsequently into the pressure port 18. The purpose of the annular area 48 is to create a tortuous path and a still space to allow communication of pressure while minimizing any particulate matter entering the port 18.

Additionally, the sand tube 40 includes a restriction 42 in the inner diameter thereof, which serves to restrict the flow of fluid through the tubular member 12. As fluid passes through the activation device 10 and encounters the restriction 42, the pressure of the fluid drops in a lower region 15 directly below the restriction 42 and increases in the upper region 44 directly above the restriction 42, thereby creating a pressure differential between the two regions 44, 15. Conversely, the velocity of the fluid decreases in the upper region 44 and increases in lower region 15. Formed in a wall of tubular member 12 is the pressure port 18. Connected in fluid communication to the pressure port 18 through a fitting 22 is a pressure sensing line 24.

To actuate the downhole tool (not shown), fluid at a predetermined flow rate is applied through the tubular member 12. As fluid moves through the restriction 42, a higher pressure is created in the upper region 44. The higher pressure is communicated into the slit 46 in the sand tube 40 through the annular area 48 into the pressure port 18 and subsequently through the pressure sensing line 24 to the downhole tool.

Although the arrangements of the actuator devices disclosed above are effective, the arrangements are not ideal in certain well conditions. For example, when running a sidetrack assembly in hole during complete fluid loss to the formation, operators have to continuously pump fluid down the drillstring while orienting the sidetrack assembly using measurement-while-drilling data. In this situation, the pumped fluid can cause these prior art activation devices 10 to activate unintentionally and/or can cause the packer to set prematurely before the assembly is properly orientated.

The subject matter of the present disclosure is directed to overcoming, or at least reducing the effects of, one or more of the problems set forth above.

SUMMARY OF THE DISCLOSURE

An assembly disclosed herein is used for creating a sidetrack in a wellbore using a downhole tool with a whipstock. The assembly is run on a drillstring communicating fluid flow. The assembly comprises a milling tool, a piston, and a releasable connection.

The milling tool is configured to support the downhole tool extending therefrom. The milling tool is configured to connect to the drillstring and has a mill. The milling tool defines a bore therethrough communicating the fluid flow from the drillstring to the mill. The bore has an uphole shoulder and has a port communicating the bore outside the milling tool.

The piston is movable from an uphole position toward a downhole position in the bore. The piston has uphole and downhole ends and defines a passageway therethrough. The passageway defines an uphole-facing surface area exposed to the fluid flow. The piston in the uphole position closes the port from the bore, whereas the piston moved from the uphole position toward the downhole position exposes the port to the fluid flow in the bore. The port is disposed in fluid communication with the downhole tool and is configured to communicate pressure from the fluid flow in the bore to the downhole tool.

The releasable connection has engaged and unengaged states with the piston. In response to a predetermined downhole force from the fluid flow in a downhole direction against the exposed surface area of the piston, the releasable connection is in the engaged state with the piston and is configured to release the piston to move from the uphole position toward the downhole position. In response to an uphole force from the fluid flow in an uphole direction against the piston, the uphole end of the piston is configured to abut the uphole shoulder of the milling tool, and the releasable connection is in the unengaged state with the piston.

The bore can have a downhole shoulder therein, and the port is disposed between the uphole and downhole shoulders. The piston is movable from the uphole position to the downhole position, in which the downhole end is engaged against the downhole shoulder in the bore.

The milling tool can comprise at least uphole and downhole housing portions. The uphole housing portion can define a portion of the bore and can have a pin connection. The downhole housing portion can have the mill and can define another portion of the bore. The downhole housing portion can be connected to the pin connection of the uphole housing portion, and the pin connection can define the uphole shoulder.

The piston can comprise an uphole sleeve and a downhole sleeve, and the releasable connection can be disposed between the uphole and downhole sleeves. The downhole sleeve can have the uphole-facing surface, and the uphole sleeve can have the uphole end. The uphole sleeve can be configured to abut the downhole shoulder. The downhole sleeve can be configured to move in the downhole direction against the connection to the uphole sleeve.

The assembly can further comprise the downhole tool with the whipstock as part of the assembly. For its part, the downhole tool can comprise: an anchor being configured to set in the wellbore, the anchor being actuated directly or indirectly by the pressure of the fluid flow communicated by the port; a packer being configured to set in the wellbore, the packer being actuated directly or indirectly by the pressure of the fluid flow communicated by the port; and/or a wellbore tool configured to be actuated in the wellbore, directly or indirectly by the pressure of the fluid flow communicated by the port.

The assembly can further comprise a line connecting the port of the milling tool with the downhole tool and communicating the pressure from the port to the downhole tool.

The piston can comprise a sleeve having the passageway constricted with the uphole-facing surface area, and the releasable connection can be disposed between the milling tool and the sleeve. Here, the sleeve can comprise a nozzle disposed in the passageway and providing at least a portion of the uphole-facing surface area. Additionally, the sleeve can comprise first and second external seals engaged in the bore. The first and second external seals on the sleeve in the uphole position in the bore can seal the port from the fluid flow in the bore.

The piston can comprise a first outer surface along the uphole end, wherein the first outer surface can have a first outer diameter less than an inner diameter of the bore of the milling tool. The first outer surface with the piston moved toward the downhole position can be configured to permit the fluid flow to communicate through an annulus between the first outer diameter and the inner diameter to the port. Here, the piston can comprise a second outer surface along the downhole end, the second outer surface having a second outer diameter near the inner diameter of the bore. Additionally, wherein the piston can define one or more openings in the uphole end communicating the passageway with the first outer surface.

The mill can define one or more openings for communicating the fluid flow from the milling tool outside the mill. The uphole shoulder of the milling tool can be configured to restrict uphole movement of the piston in response to a reverse of the fluid flow in the uphole direction from the one or more openings toward the drillstring.

In one arrangement, the releasable connection can comprise at least one shear screw disposed in the milling tool, the at least one shear screw disposed in at least one channel defined in an outer surface of the piston. Here, an uphole edge of the channel can be engageable against the at least one shear screw for the releasable connection in the engaged state in response to the piston urged in the downhole direction from the uphole position. Meanwhile, the uphole end of the piston can shoulder against the uphole shoulder of the bore before the at least one shear screw can be engageable with a downhole edge of the channel for the releasable connection in the unengaged state in response to the piston urged in the uphole direction from the uphole position.

In another arrangement, the releasable connection can comprise at least one collet finger disposed on the piston. The collet finger can have a head configured to engage in a groove in the bore of the housing. The head for the releasable connection in the engaged state can be disengagable from the groove in response to the piston urged in the downhole direction from the uphole position. Meanwhile, the uphole end of the piston can shoulder against the uphole shoulder of the bore before the head for the releasable connection in the unengaged state can be disengagable from the groove in response to the piston urged in the uphole direction from the uphole position.

In yet another arrangement, the releasable connection can comprise at least biasing element disposed in the bore of the housing between the downhole end of the piston and a downhole shoulder of the housing. The at least one biasing element for the releasable connection in the engaged state can be compressed by the piston in response to the piston urged in the downhole direction from the uphole position. Meanwhile, the uphole end of the piston can shoulder against the uphole shoulder of the bore while the at least one biasing element for the releasable connection in the unengaged state can be uncompressed by the piston in response to the piston urged in the uphole direction from the uphole position.

According to the present disclosure, a milling tool is used for creating a sidetrack in a wellbore. The milling tool is run on a drillstring communicating fluid flow. The tool comprises a mill, a housing, a piston, and a releasable connection. The housing is connected to the mill and defines a bore therethrough. The bore has an uphole shoulder therein. The bore communicates the fluid flow from the drillstring to the mill, and the housing has a port communicating the bore outside the housing.

The piston is movable from an uphole position toward a downhole position in the bore of the housing. The piston has uphole and downhole ends and defines a passageway therethrough. The uphole end is configured to abut the uphole shoulder of the housing. The passageway defines an uphole-facing surface area exposed to the fluid flow. The piston in the uphole position closes the port from the bore. The piston moved from the uphole position toward the downhole position exposes the port to the fluid flow in the bore. The port is configured to communicate pressure from the fluid flow in the bore outside the housing.

The releasable connection temporarily holds the piston in the uphole position. The connection is configured to release the piston to move from the uphole position toward the downhole position in response to a predetermined force from the fluid flow in a downhole direction against the exposed surface area of the piston.

According to the present disclosure, a method uses fluid flow through a drillstring in a wellbore. The method comprises: running a sidetrack assembly on the drillstring in the wellbore, the sidetrack assembly having a milling tool and a downhole tool, the milling tool having a mill and a port, the downhole tool extending downhole from the milling tool, the port disposed in fluid communication with the downhole tool; flowing the fluid flow down the drillstring and out of the mill during run-in of the sidetrack assembly by closing off the port with a piston disposed in an uphole position in the milling tool; preventing premature activation of the downhole tool from the communicated fluid flow by preventing downhole movement of the piston from the uphole position to a downhole position opened relative to the port and preventing uphole movement of the piston from the uphole position with an uphole shoulder in the milling tool; communicating the fluid flow from the port to the downhole tool by increasing the flowing of the fluid flow through the piston and shifting the piston from the uphole position to the downhole position opened relative to the port; and activating the downhole tool with the fluid flow communicated from the port.

In the method, closing off the port with the piston disposed in the uphole position in the milling tool can comprise sealing uphole and lower seals disposed about of the piston in a bore of the milling tool on uphole and downhole sides of the port.

Preventing the downhole movement of the piston from the uphole position to the downhole position opened relative to the port can comprise engaging a downhole-facing edge of a channel on the piston against at least one releasable connection disposed in the milling tool.

Preventing the uphole movement of the piston from the uphole position with the shoulder in the milling tool can comprise shouldering an uphole end of the piston against the shoulder before engaging an uphole-facing edge of the channel against the at least one releasable connection disposed in the milling tool.

Increasing the flowing of the fluid flow through the piston and shifting the piston from the uphole position to the downhole position opened relative to the port can comprise restricting the flowing of the fluid flow through a restriction of the piston and shearing the at least one releasable connection with a predetermined force produced by the restricted fluid flow.

The foregoing summary is not intended to summarize each potential embodiment or every aspect of the present disclosure.

DETAILED DESCRIPTION OF THE DISCLOSURE

Figure 1A:
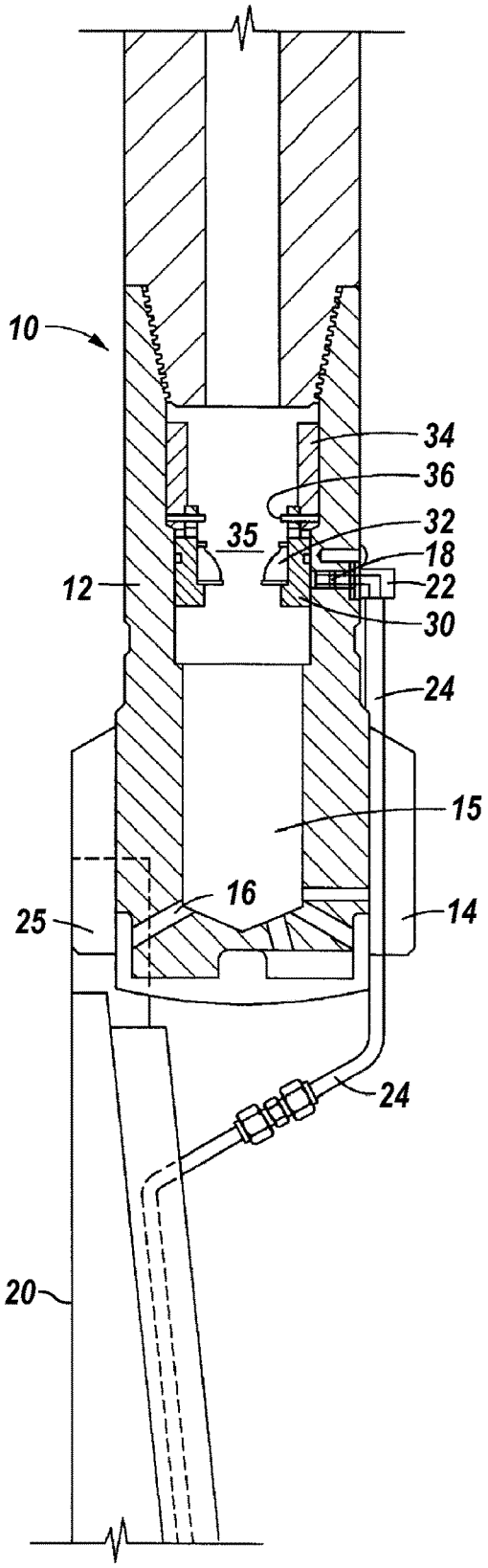
FIG. 1A (Prior Art)
FIGS. 1A-1B illustrate cross-sectional views of an activation device of the prior art for use in a sidetrack assembly having a whipstock for diverting a milling tool to create a sidetrack wellbore.
Figure 1B:
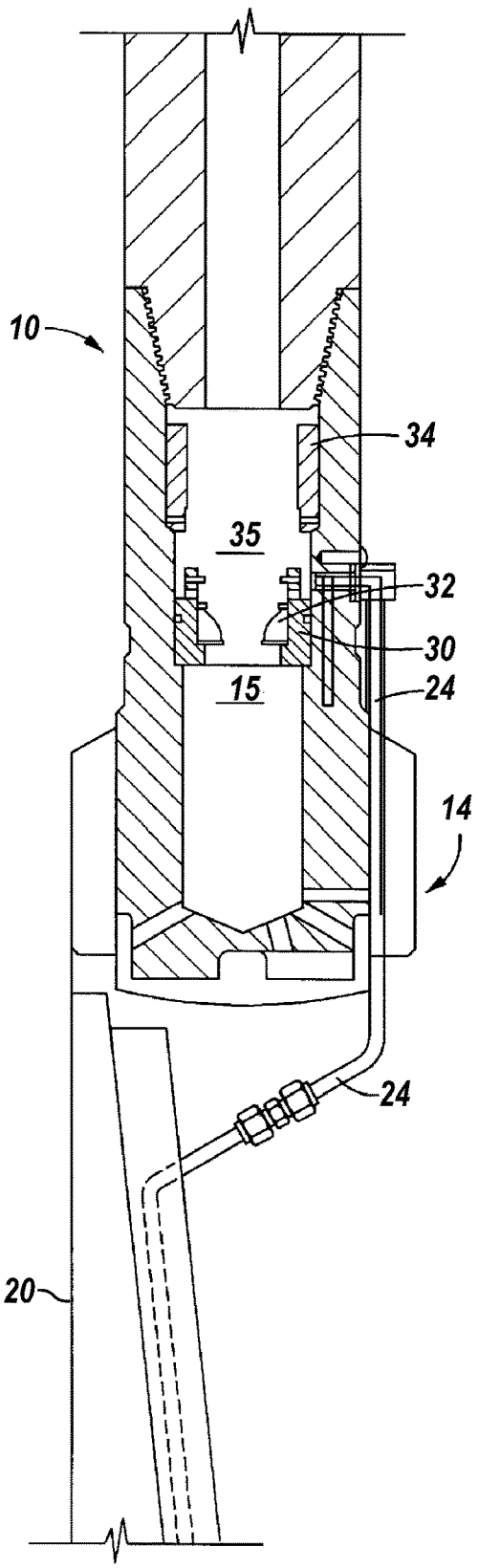
FIG. 1B (Prior Art)
Figure 2:
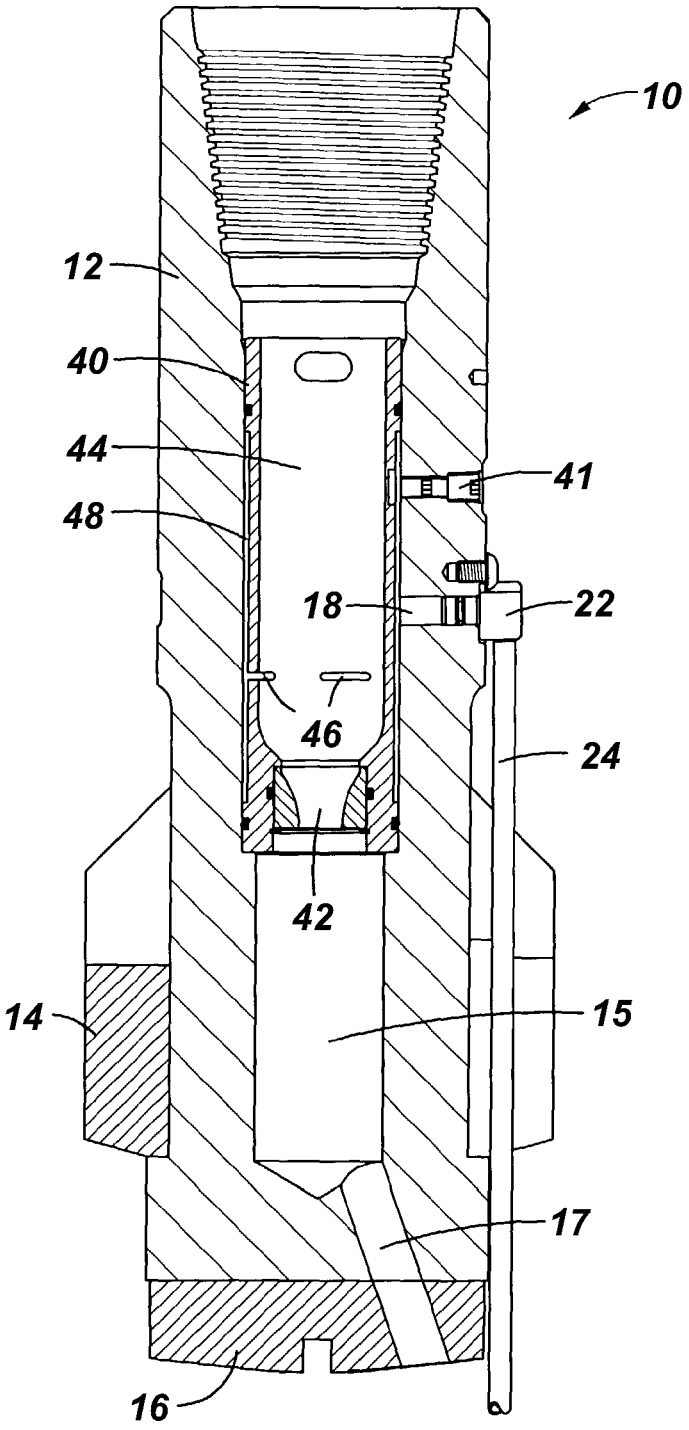
FIG. 2 (Prior Art)
FIG. 2 illustrates a cross-sectional view of another activation device of the prior art for use in a sidetrack assembly.
Figure 3A:
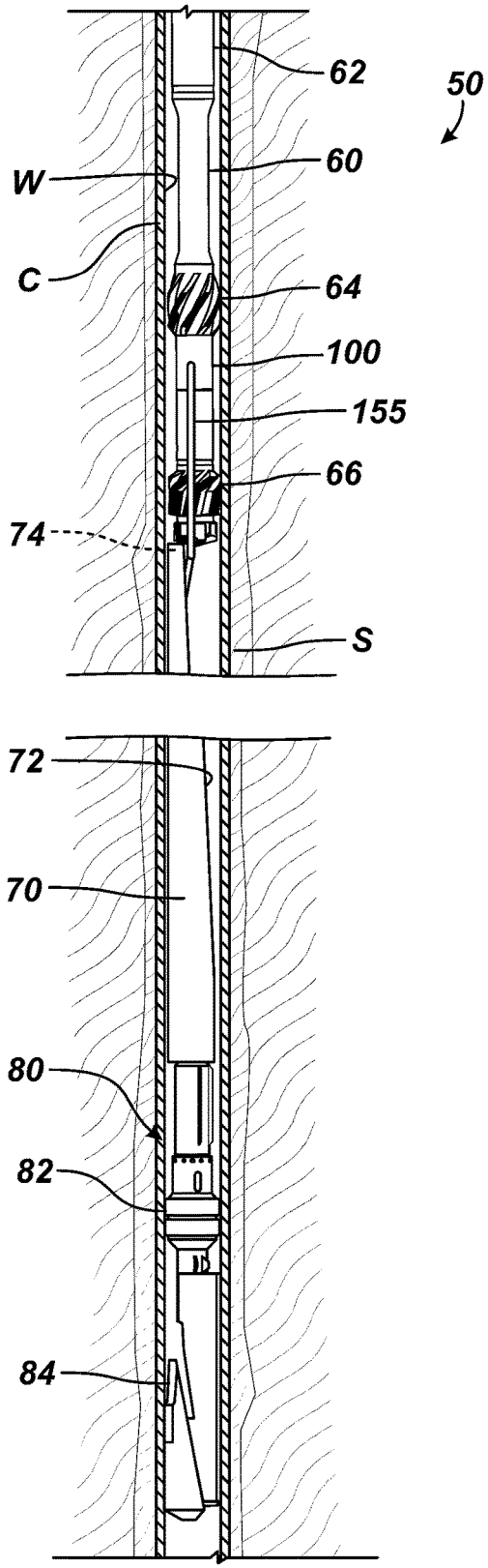
FIGS. 3A-3B illustrate a sidetrack assembly of the present disclosure for use in drilling a sidetrack wellbore.
Figure 3B:
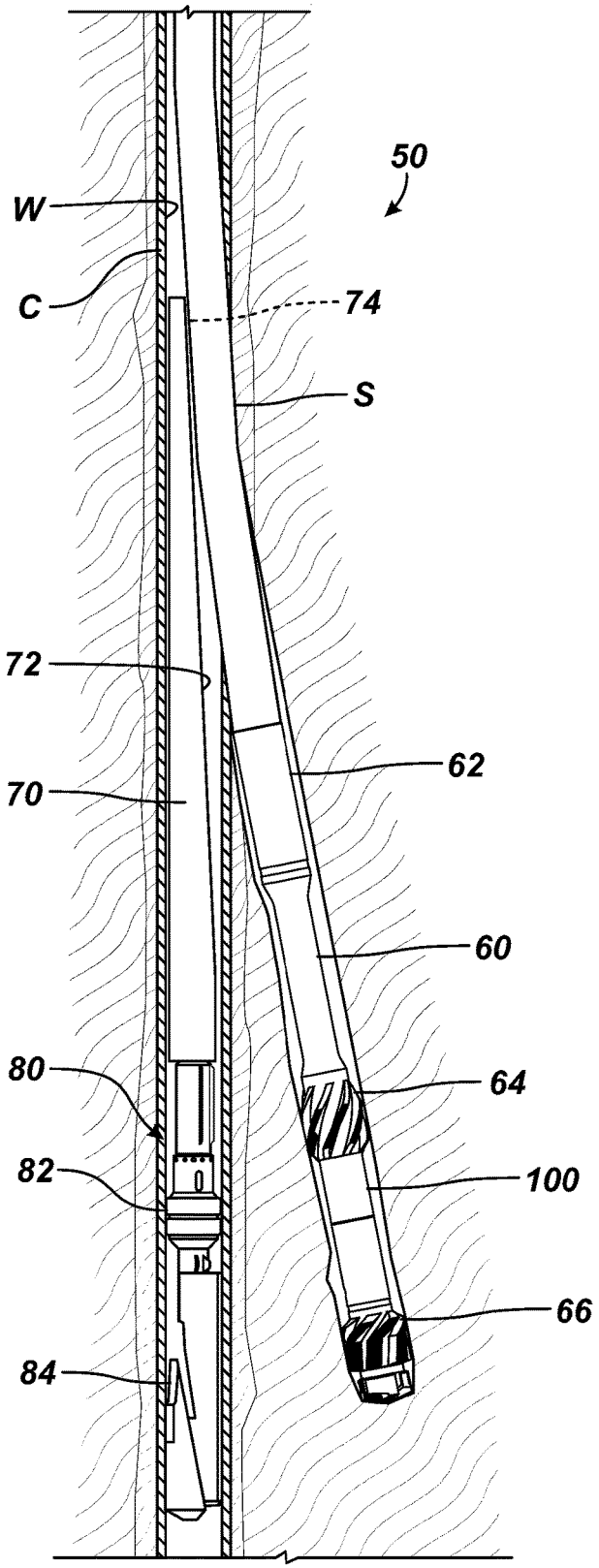

FIGS. 3A-3B illustrate a sidetrack system 50 according to the present disclosure to create a sidetrack wellbore. The sidetrack system 50 includes a milling tool 60, a measurement-while-drilling (MWD) device 62, a stabilizer 64, an initiator 100, and a window mill 66 disposed on a drillstring S. The system 50 also includes a whipstock 70 for diverting the milling tool 60 and includes a downhole tool 80 for setting the whipstock 70 in the casing C. The downhole tool 80 can include a packer 82, an anchor 84, and any other tools, which can hydraulically-operated or hydraulically-initiated.

The initiator 100 is directed to preventing premature setting of the sidetrack assembly 50 (e.g., the assembly's packer 82) when running-in and orienting the assembly 50 in a wellbore, especially in a wellbore experiencing total fluid loss.

As shown here, the whipstock 70 includes a whip, which is a wedge-shaped member with a concave face 72 that can steer the mill or cutter 66 to the side of the casing C where a window can be formed. The lower end of the whipstock 70 connects to the downhole tool 80, which is shown having the packer 82 and the anchor 84.

When run in hole, the whipstock 70 is attached to the mill 66 at a releasable coupling (74) at the tip of the whipstock 70. In this way, the whipstock 70 and the downhole tool 80 depend from the milling tool 60 so all of the components of the system 50 can be run in together into the casing C. The MWD device 62 provides the operator at surface with information about the assembly's location in the borehole W and the orientation of the sidetrack system 50, among a variety of other downhole measurements and data.

Fluid flow is needed to orient the sidetrack assembly 50 with the MWD device 62, which uses mud-pulse telemetry to telemeter information to surface. Once orientation of the assembly 100 is complete with the MWD tool 62, the initiator 100 then provides a controlled method of setting the packer 82, anchor 84, and/or tools 80 below the whipstock 70.

During run in, the initiator 100 is unactivated so that hydraulic pressure is not transmitted through the pressure line 155. Once the assembly 50 is situated, the fluid flow through the initiator 100 is increased to open the initiator 100, allowing pressure to communicate to the pressure line 155 connected from the initiator 100 to the downhole tool 80. In turn, this pressure through the pressure line 155 is used to set the packer 82, anchor 84, and/or other downhole tools 80 below the whipstock 70 of the assembly 50 either directly or indirectly. For example, both the packer 82 and the anchor 84 can be hydraulically operated to set in the whipstock 70 in the casing C. Pressure in the pressure line 155 can directly actuate the packer 82 or the anchor 84 through pistons and piston chambers or other hydraulic actuators. Alternatively, pressure in the pressure line 155 may initiate actuation of the packer 82 and/or anchor 84 by triggering some other actuator to perform the setting. Such an actuator can have an atmospheric chamber, which is breached in response to the pressure in the pressure line 155 and which then actuates the packer 82 and/or anchor 84. Although both the packer 82 and anchor 84 can be set hydraulically, it is possible that one of them can be set hydraulically, followed by the other being set manually using pulling or set down force on the assembly 50.

When the packer 82 is activated, a packing element of the packer 82 is compressed to seal off the borehole W below the packer 82. For its part, the anchor 84 can include a set of slips and cones that fix the sidetrack system 50 in the borehole W or can include wedged bodies, such as the anchor disclosed in U.S. Pat. No. 7,963,341, incorporated herein by reference in its entirety.

After the downhole tool 80 has been set, the mill 66 is separated from the whipstock 70 by releasing the coupling 74, which can include a releasable connection commonly used for the purpose. Once separated, the mill 66 is then operated to mill a window in the casing C. During this process, the inclined face 72 of the whipstock 70 is used to cam the window mill 66 into engagement with the casing C. Eventually, a sidetrack can be started off the borehole W, as shown in FIG. 3B.

As discussed above, the initiator 100 is used for controlling communication of hydraulic pressure from the milling tool 60 to operate the downhole tool 80, such as by hydraulically activating the packer 82 and anchor 84. An initiator 100 of the present disclosure is shown in a run-in state in FIGS. 4A-4B and is shown in an activated state in FIGS. 5A-5B.

As shown again and discussed above, the sidetrack assembly 50 includes the initiator 100 on the milling tool 60, which is disposed on the drillstring (not shown) and has the mill 66. Only a portion of the milling tool 60 is shown here. The whipstock 70 and other components of the downhole tool (80) extend from the milling tool 60 as noted previously. The initiator 100 is installed above the mill 66. As is typical, the mill 66 includes a plurality of cutters and includes flow ports 67 that provide an exit for fluids pumped from the well surface.

The initiator 100 includes a housing 110, a piston 120, at least one releasable connection 140*a*, and a pressure fixture 150. The housing 110 is disposed on the milling tool 60 and defines a bore 112 therethrough. In fact, the housing 110 can be part of the mill body having the head of the mill 66 and flow ports 67. The bore 112 has an uphole shoulder 114 and a downhole shoulder 116 therein, and the bore 112 communicates fluid flow from the drillstring to the mill 66.

The housing 110 also has a port 118 communicating the bore 112 outside a side of the housing 110 between the uphole and downhole shoulders 114, 116. The pressure line 155 connects with the pressure fixture 150 to the port 118 of the housing 110 and passes to the whipstock 70 to communicate with the downhole tool (not shown).

Internal to the device 100, the piston 120 is movably disposed in the bore 112 of the housing 110. The piston 120 has uphole and downhole ends and defines a passageway 122 therethrough between the uphole and downhole ends. In general, the passageway 112 defines an upward-facing surface area or restriction 130 exposed to the fluid flow. The piston 120 also has first and second external seals 126 engaged in the bore 120.

The piston 120 in a unactivated, run-in position (FIGS. 4A-4B) in the bore 112 has its uphole end adjacent the uphole shoulder 114, and the first and second seals 126 on the outside of the piston 120 seal the port 118 so fluid in the bore 112 does not reach the port 118. By contrast, the piston 120 in an activated position (FIGS. 5A-5B) in the bore 112 has its downhole end adjacent the downhole shoulder 116, and the moved piston 120 exposes the port 118 to the fluid flow in the bore 112. As detailed below, the restriction 130 is used to create back-pressure to stroke the hydraulic piston 120 open relative to the port 118, which allows the fluid flow to reach the pressure line 155 for setting the packer and/or other tools below the whipstock 70. After opening, the fluid flow can continued to pass through the hydraulic piston 120 and the restriction 130 to the mill head 66 for washing away passes.

The initiator 100 includes a releasable connection 140*a* having engaged and unengaged states with the piston 120. As shown in the present arrangement, the releasable connection 140*a* includes at least one shearable member 141 disposed in the housing 110 and having an end disposed in a channel 127 on the side of the piston 120 in the housings bore 112. The at least one shearable member 141 can be a shear pin, a shear screw, a shear ring, or other component used in the art. As discussed in more detail below, in response to a predetermined downhole force from the fluid flow in a downhole direction against the exposed surface area of the piston 120, the releasable connection (including shearable member 141 in the slot 127) has an engaged state with the piston 120 and is configured to release the piston 120 to move from an uphole position toward a downhole position in the bore 112. Yet, in response to an uphole force from the fluid flow in an uphole direction against the piston 120, the uphole end of the piston 120 is configured to abut the uphole shoulder 114, and the releasable connection 140*a* (127, 141) is in an unengaged state with the piston 120.

Figure 4A:
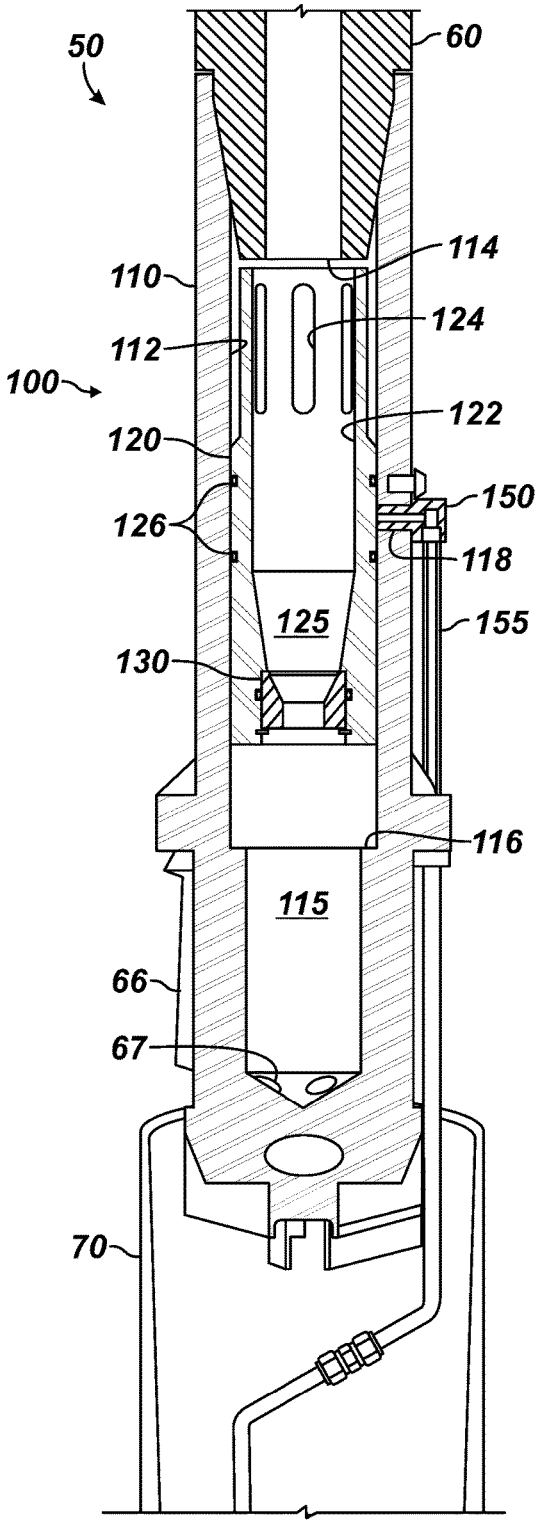
FIGS. 4A-4B illustrate cross-sectional views of an initiator of the present disclosure in an unactivated state for use in the sidetrack assembly.
Figure 4B:
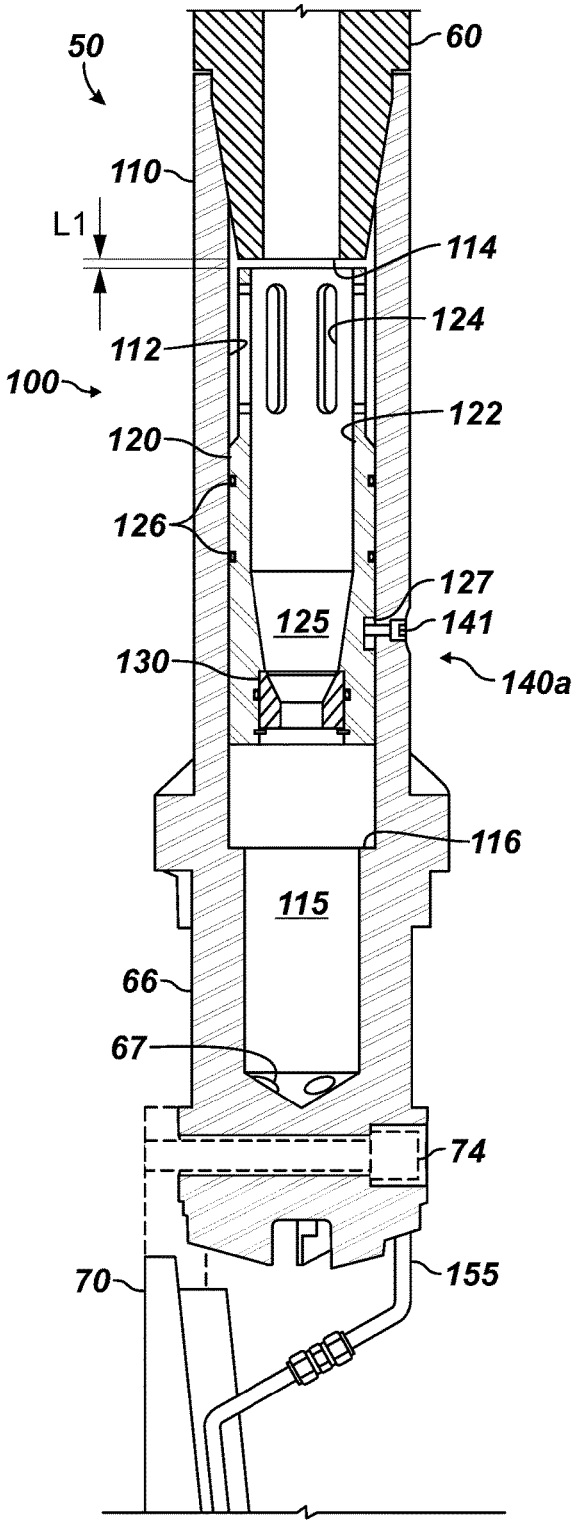

Accordingly, the releasable connection 140*a* temporarily holds the piston 120 in the unactivated position (FIGS. 4A-4B). The releasable connection 140*a* is configured to release the piston 120 to move from the unactivated position (FIGS. 4A-4B) to the activated position (FIGS. 5A-5B) in response to a predetermined force from the fluid flow in a downhole direction against the exposed surface area or restriction 130 of the piston 120.

As shown in detail, the piston 120 includes a sleeve having the passageway 122 constricted toward the downhole end with the upward-facing surface area or restriction 130. Moreover, the sleeve 120 can include a nozzle disposed in the passageway 122 to provide some of the upward-facing surface area for the restriction 130 of the fluid flow through the passageway 122. The nozzle of the restriction 130 can be held in place with a retaining ring and can include a seal with the passageway 122.

The restriction 130 in the passageway 122 serves to restrict the flow of fluid through the housing 110. As fluid flow passes through the bore 112 of the housing 110 and through the passageway 122 of the piston 120, the fluid flow encounters the restriction 130. The pressure of the fluid flow drops in a downhole region 115 downhole of the restriction 130 and increases in an uphole region 125 directly uphole of the restriction 130, thereby creating a pressure differential between the two regions 115, 125. Conversely, the velocity of the fluid decreases in the uphole region 125 and increases in the downhole region 115. This produces a force on the piston 120, forcing it downhole in the housing against the releasable connection 140*a*.

Figure 5A:
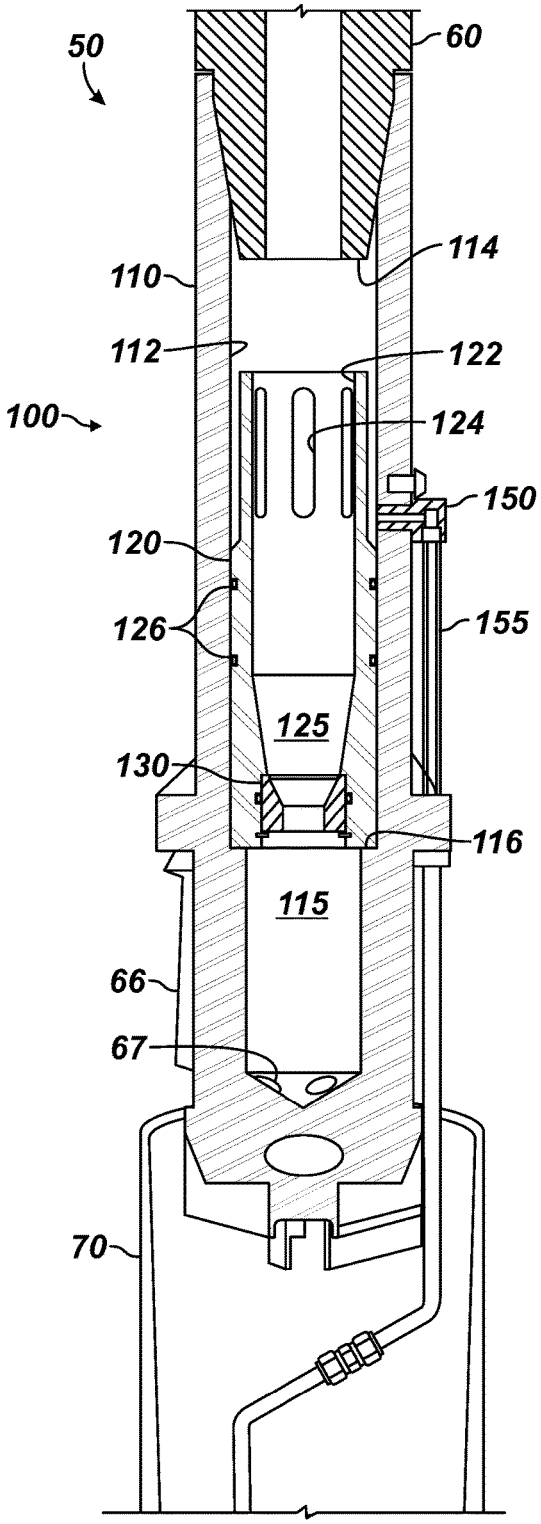
FIGS. 5A-5B illustrate cross-sectional views of the initiator of the present disclosure in an activated state for use in the sidetrack assembly.
Figure 5B:
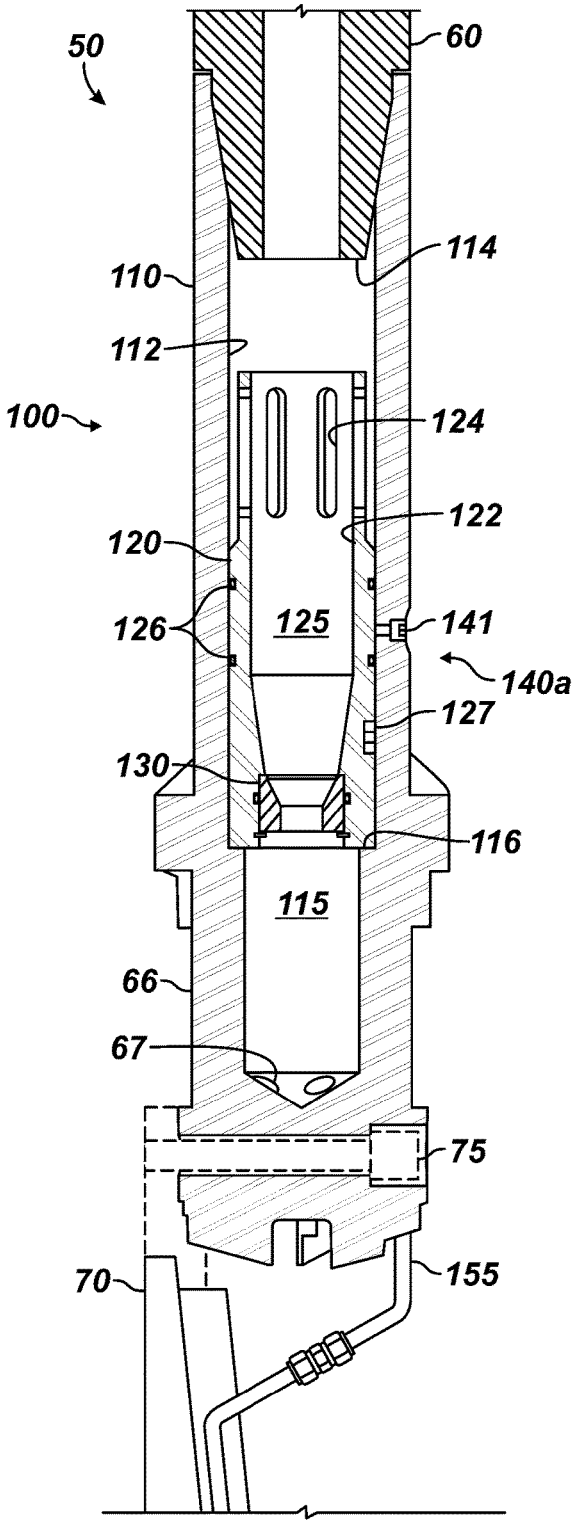
Figure 6:
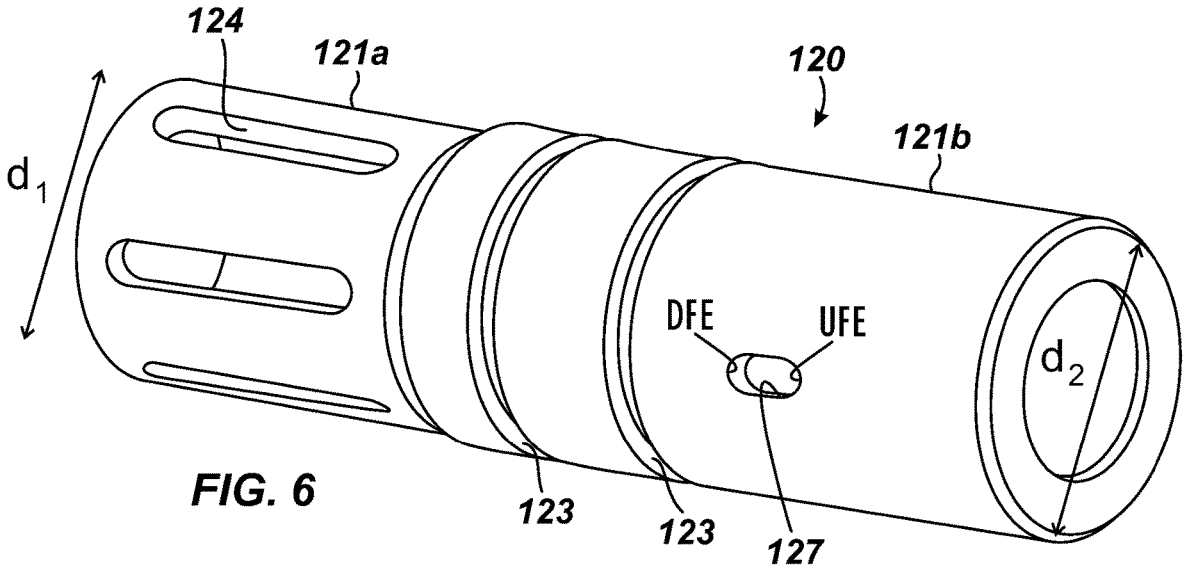
FIG. 6 illustrates a perspective view of a piston for the disclosed initiator.

Moreover and as also shown in FIG. 6, the piston 120 includes a first outer surface along an uphole portion (121*a*: FIG. 6) of the uphole end. The uphole portion (121*a*) has a first outer diameter ($d_1$) that is less than an inner diameter of the bore 112 of the housing 110. In this way, when the piston 120 is moved to the activated position as shown in FIGS. 5A-5B, the uphole portion (121*a*: FIG. 6) of the piston 120 is configured to permit the fluid flow to communicate through an annulus between the sleeve's outer diameter and the bore's inner diameter to the port 118. To further enhance flow, the piston 120 can define slots 124 through the uphole portion (121*a*: FIG. 6) at the uphole end, and the slots 124 can communicate the piston's passageway 122 with the outer surface so additional fluid flow can be communicated to the port 118 when opened.

By contrast, the piston 120 includes a second outer surface along a downhole portion (121*b*: FIG. 6) at the downhole end. The downhole portion (121*b*: FIG. 6) has a second outer diameter ($d_2$) near to that of the inner diameter of the bore 112 so that the external seals 126 can seal off the annular space between the piston 120 and the bore 112. As shown in FIG. 6, the second portion 121*b* defines grooves 123 for the seals (126), which can be O-ring seals. The second portion 121*b* also defines a channel 127 for the releasable connection (140*a*). As shown, the channel 127 has a downhole-facing edge (DFE) that can abut against the releasable connection (140*a*) to shear the connection (140*a*) when the piston 120 is moved in a downhole direction. The channel 127 as shown has an uphole-facing edge (UFE), but this is not strictly necessary. As discussed below, the uphole-facing edge (UFE) is situated so as not to abut against the releasable connection (140*a*) before the piston 120 can shoulder against the uphole shoulder (114) in the housing (110).

In the unactuated position illustrated in FIGS. 4A-4B, the piston 120 is held in an uphole stationary position with the releasable connection 140*a* disposed in the channel 127. With the initiator 100 in its unactuated state, the pressure line 155 is sealed off by the pair of seals 126 disposed about the piston 120.

As noted above, the releasable connection 140*a* can include at least one shearable element, such as a shear screw or a shear pin, disposed in the side of the housing 110. Being shearable, the releasable connection 140*a* is constructed and arranged to fail upon application of a certain force thereto. The force exerted upon the releasable connection 140*a* is determined by the flow rate and pressure of fluid through the initiator 100, as discussed herein. While the releasable connection 140*a* can include a shearable member 141, such as the shear screw or shear pin used here, the initiator 100 can use any releasable connection, including, but not limited to an indexing collet and groove arrangement, a compressible ring and groove arrangement, a shear ring, a biasing element or compression spring, and the like. Further examples are discussed below with reference to FIGS. 11A-11B.

During use, the sidetrack assembly 50 of the present disclosure is run on the drillstring in the wellbore. Operators flow fluid down the drillstring and out of the mill's openings 67 during run-in to facilitate tripping of the assembly, to maintain well control, and/or to use the MWD tool (62). Pumping through the assembly 50 is required to orient the assembly 50 while using the MWD tool (62). During this pumping, pressure must be kept from communicating to the pressure line 155, as this would prematurely activate the assembly 50 to set in the wellbore. Eventually, pressure is allowed to flow to the control line 155 to set the assembly 50 by increasing the fluid flow above a pumping rate that was needed to orient the assembly 50 with the MWD tool (62).

During the pumping to orient the assembly, for example, the fluid flow can pass out the mill's openings 67. However, the fluid flow does not communicate pressure to the pressure line 155 because the piston 120 disposed in an uphole position in the housing 110 closes off the port 118 for the pressure line 155 using the upper and lower seals 120 on uphole and downhole sides of the port 118.

When the sidetrack system 50 is properly located and orientated, fluid flow is then communicated to the pressure line 155 to actuate the downhole tool (80) below the whipstock 70 either directly or indirectly. To do this, the fluid flow through the initiator 100 is increased, and the piston 120 is pushed against the releasable connection 140*a*. In use, the shear strength for the connection 140*a* is set above a flow rate used to orient the MWD device 62. As an example, the shear value can be approximately 5750-lbf or approximately 550-gpm for a piston having a piston area of about 5.466 $in^2$. Once the shearable member 141 of the releasable connection 140*a* shears, the piston 120 is shifted from the uphole position to the downhole position opened relative to the port 118. The downhole tool (80) can then be activated with the fluid pressure communicated to the pressure line 155 from the port 118.

To increase the fluid flow through the piston 120 and shift the piston 120 from the uphole position to the downhole position, the fluid flow is preferably restricted through the restriction 130 of the piston 120. The fluid flow is applied at a predetermined flow rate through the housing 110. As the fluid moves through the restriction 130, the pressure rises in the uphole region 125. A certain flow rate then produces a force at the restriction 130 corresponding to the pressure differential and adequate to overcome the shear strength of the releasable connection 140*a*. At this point, the at least one releasable connection 140*a* is sheared by the predetermined force produced by the restricted fluid flow. Thereafter, the piston 120 moves into the position illustrated in FIGS. 5A-5B.

As shown in FIG. 5B, in its actuated position, the initiator 100 places the pressure line 155 in fluid communication with the uphole region 125 of the housing 110 above the restriction 130. In this manner, the pressure line 155 is exposed to the higher pressure created by the flow of fluid through the restriction 130. The pressure line 155 transmits this increased pressure to the downhole tool (80). At the same time, flow can continue through the nozzle restriction 130 allowing the flow out of the mill head 66 for use in the milling operation.

As further shown in FIG. 5B, the external seals 126 on the piston 120 seal off the releasable connection 140*a* disposed in the housing 110 to eliminate any flow through its threaded aperture in the housing 110. In particular, the location of the releasable connection 140*a* is sealed by the external seals 126 on the piston 120 after opening fluid flow to the port 118. This provides further sealing integrity to the flow path through the initiator 100 to the mill 66 because fluid can be prevented from passing out of the bore 112 through the releasable connection 140*a* in the housing 110. Moreover, any shear screw used for the connection 140*a* may not require an National Pipe Thread (NPT) plug seal, although one could be used if desired.

If desired, the piston 120 can incorporate sand control features to prevent sand from clogging up the pressure port 118 formed in the housing 110. The slots 124 can be appropriately dimensions and placed to create a tortuous path of fluid flow from the piston's passageway 122 to the port 118. The uphole end of the piston 120 may include an O-ring seal (not shown) to seal with the bore 112 so that fluid flow must pass through the slots 124 to reach the annular space exposed to the port 118.

Figure 10:
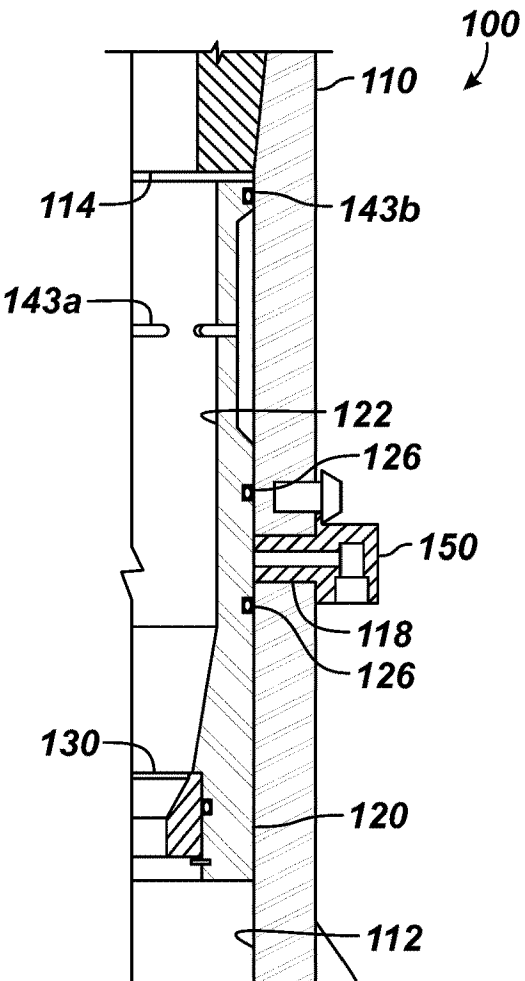
FIG. 10 illustrates a cross-sectional view of an initiator of the present disclosure having sand control features.

As a brief example of this, FIG. 10 illustrates the piston 120 incorporate sand control features to prevent sand from clogging up the pressure port 118 formed in the housing 110. Slots 143*a* can be appropriately dimensions and placed in the piston 120 to create a tortuous path of fluid flow from the piston's passageway 122 to the port 118. The uphole end of the piston 120 may include an O-ring seal 143*b* to seal with the bore 112 so that fluid flow must pass through the slots 143*a* to reach the annular space exposed to the port 118.

Based on the details above with respect to FIGS. 4A-4B, 5A-5B and 6, the initiator 100 avoids premature activation of the downhole tool (80) from the communicated fluid flow during run in and orienting by (i) sealing off the housing's port 118 using the external seals 126 on the piston 120; (ii) preventing downhole movement of the piston 120 from the uphole position to the downhole position using the releasable connection 140*a*; and (iii) limiting uphole movement of the piston 120 from the uphole position using the shoulder 114 in the housing 110. In particular, to prevent the downhole movement of the piston 120, the downhole-facing edge (DFE) of the channel 127 on the piston 120 can engage against the at least one releasable connection 140*a* disposed in the milling tool's housing 40 at least until a predetermined force is applied.

To limit the uphole movement, upward stroking of the piston 120 is limited by the uphole shoulder 114. In particular, an uphole end of the piston 120 can shoulder against the uphole shoulder 114 before an uphole-facing edge (UFE) on the piston's channel (127) can engage against the at least one releasable connection 140*a* disposed in the milling tool's housing 110. This shoulder can ensure that there is no load placed on the releasable connection 140*a*.

For example, fluid may come in from below the piston 120 through the mill openings 67 during run-in and while orienting the assembly 50. The reverse fluid may move the piston 120 upward, but the upward movement of the piston 120 is stopped by the shoulder 114 in the housing 110. As shown here in FIGS. 4A-4B and 5A-5B, this shoulder 114 can correspond to a downhole pin end of a portion of the mill 60 attached to the housing 110, such as a body of a flex mill, a watermelon mill, a steerable mill, or other member of a bottom hole assembly. In this way, should any upward movement of the piston 120 occur, the movement will not stress the releasable connection 140*a*.

Figure 7:
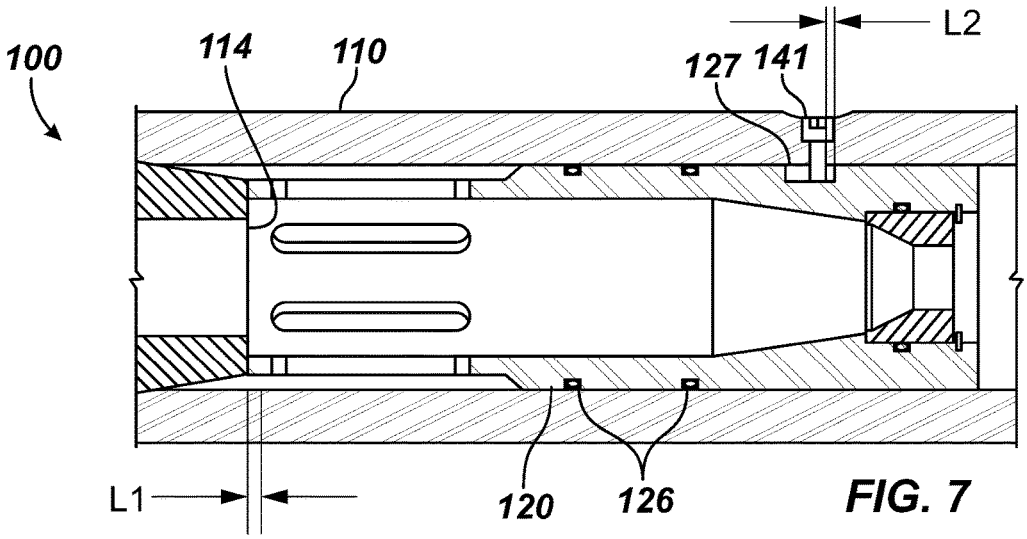
FIG. 7 illustrates the initiator when exposed to reverse flow.

As shown in detail in FIG. 7, the at least one shearable member 141 of the releasable connection (140*a*) extends into the at least one channel 127 defined in the outer surface of the piston 120. The downhole-facing edge (DFE) of the channel 127 is engageable against the at least one shearable member 141 in response to the piston 120 being urged in a downhole direction from the first position toward the second position. However, the uphole shoulder 114 of the housing 110 is configured to restrict upward movement of the piston 120 in response to a reverse of the fluid flow in an uphole direction from the one or more mill openings 67 toward the drillstring. To achieve this, the uphole end of the piston 120 shoulders against the uphole shoulder 114 of the bore 112 before the at least one shearable member 141 is engaged by the uphole-facing edge (UFE) of the channel 127 in an uphole direction. To achieve this, any play (distance L1) that the piston 120 can move uphole in the housing 110 before engaging the shoulder 114 still leaves a clearance (distance L2) between the downhole edge of the channel 127 from the shearable member 141.

In general, the area of the piston 120 is the same with respect to fluid flow coming from above and below. Fluid coming in from below the piston 120 can move the piston upward by a distance L1 (which can be, but not restricted to, approximately 0.19"). However, the piston 120 is stopped by the shoulder 114 formed from the lower end of the flex mill. The upward movement of the piston 120, if this occurs, will not stress the shearable member 141, which instead is spaced a distance L2 from any lower edge of the slot 127 (which can be, but not restricted to, a 0.085" clearance).

Using the initiator 100, the sidetrack system 50 can pass a flow rate of fluid therethrough sufficient to operate the MWD device (62) located in the running string without actuating a hydraulically-operated or hydraulically-initiated tool downhole therebelow. After operation of the MWD (62), the flow rate of fluid can be increased to a level that creates a force sufficient to overcome the shear resistance of the releasable connection 140*a* of the initiator 100 so the downhole tool (80) may then be actuated directly or indirectly.

The initiator 100 does not require additional circulation valves and/or control subassemblies to be used above the mill 66. Instead, the disclosed initiator 100 is completely retained within the mill body 110 and does not require additional components within the assembly. In this way, the flow path for milling can remain the same.

Figure 8:
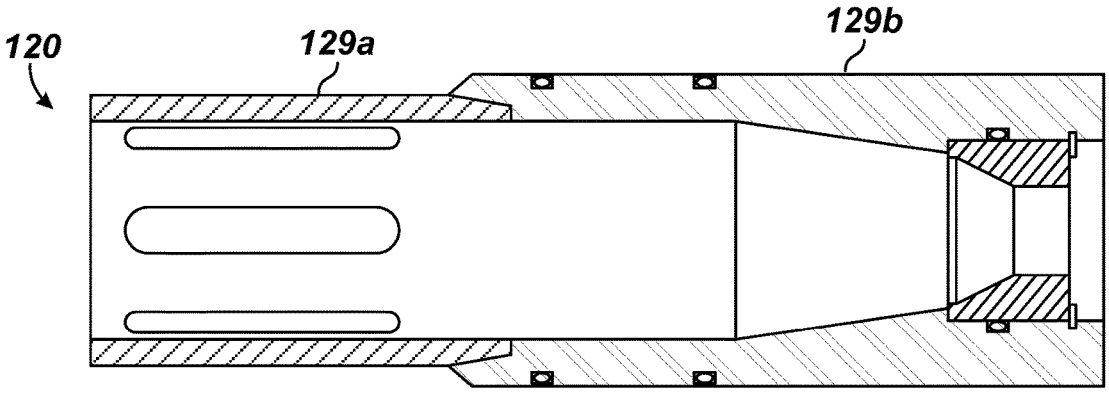
FIG. 8 illustrates a cross-sectional view of an alternative piston for the disclosed initiator.

The hydraulic piston 120 is shown here as one integral manufactured part strategically located within the mill body 110. As will be appreciated, the piston 120 can be constructed of two or more interconnected parts. As shown in FIG. 8, for example, the hydraulic piston 120 can be constructed of multiple pieces 129*a-b* with a cage separator 129*a* having the side openings 124.

Figure 9C:
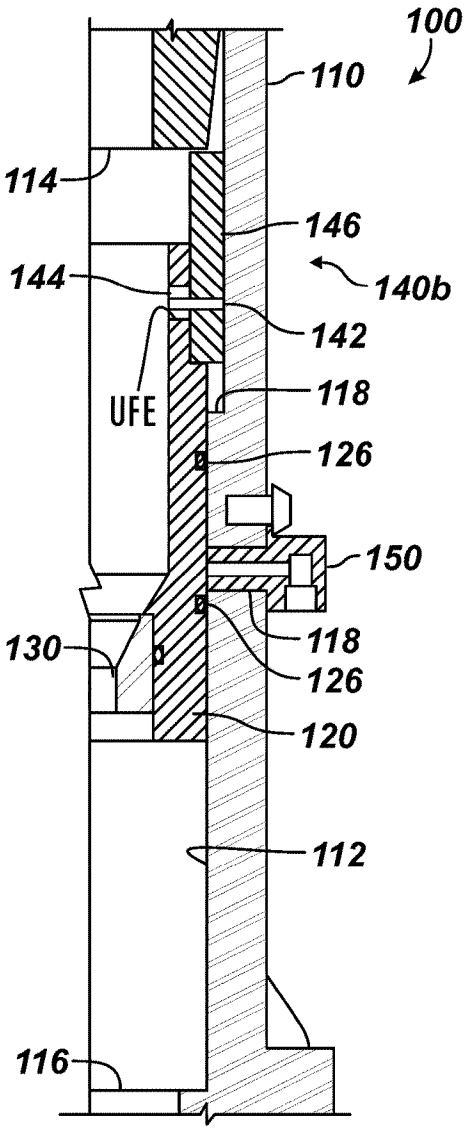
FIGS. 9A-9C illustrate cross-sectional views of another initiator of the present disclosure in different states for use in the sidetrack assembly.
Figure 9B:
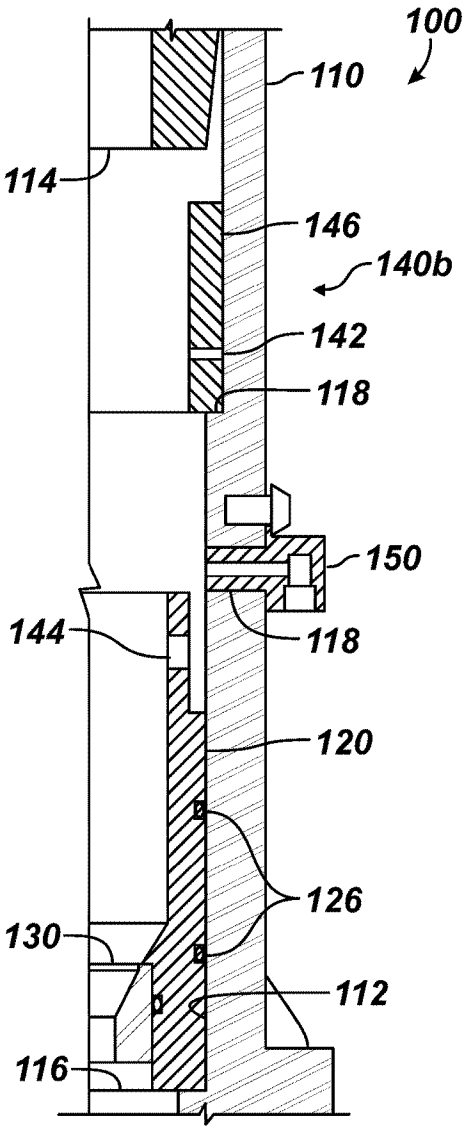
Figure 9A:
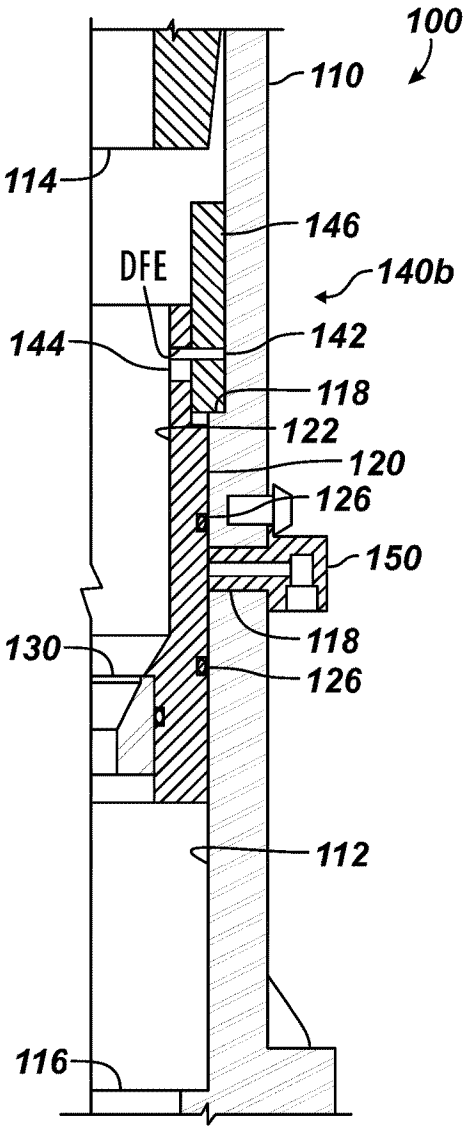

FIGS. 9A-9C illustrate cross-sectional views of another initiator 100 of the present disclosure in different states for use in the sidetrack assembly (50). Comparable reference numerals are used for comparable components to the other embodiments disclosed herein—the descriptions of which are reincorporated here.

As before, the initiator 100 includes a housing 110, a piston 120 movable in the housing's bore 112, a restriction 130 in the passageway 122 of the piston 120, and a pressure fixture 150 in the housing's port 118.

The initiator 100 also includes a releasable connection 140*b* having engaged and unengaged states with the piston 120. The releasable connection 140*b* includes at least one shearable member 142 disposed in a floating sleeve 146 and having an end disposed in a channel or slot 144 on the side of the piston 120. As discussed in more detail below, in response to a predetermined downhole force from the fluid flow in a downhole direction against the exposed surface area of the piston 120, the releasable connection 140*b* (including shearable member 142, slot 144, and sleeve 146) has an engaged state with the piston 120 and is configured to release the piston 120 to move from an uphole position toward a downhole position in the bore 112. Yet, in response to an uphole force from the fluid flow in an uphole direction against the piston 120, the uphole end of the piston 120 is configured to abut the uphole shoulder 114 through the floating sleeve 146, and the releasable connection (142, 144, 146) is in an unengaged state with the piston 120.

Rather than using at least one releasable connection disposed in the housing 110, the piston 120 in this arrangement includes the floating sleeve 146 having one or more shearable members 142 to the one or more slots 144 in the piston 120. In an unactivated, run-in state of FIG. 9A, such as when downward fluid flow passes through the housing 110 and the piston 120, the floating sleeve 146 abuts an intermediate shoulder 118, and the one or more shearable members 142 are engaged by the downhole-facing edge (DFE) of the one or more slots 144 to hold the piston 120 closed relative to the housing's port 118. In response to a predetermined force on the piston 120 caused by the fluid flow through the restriction 130, the one or more shearable members 142 shear and release the piston 120 to move open relative to the port 118, as shown in FIG. 9B. The external seals 126 on the piston 120 move away from the port 118, which is then exposed to the high pressure in the housing's bore 112 above the restriction 130. Pressure can the be communicated to the control line (not shown).

Should reverse fluid flow be encountered during run-in and orienting before opening the piston 120, the floating sleeve 146 and the piston 120 as shown in FIG. 9C do not stress the one or more shearable members 142. In particular, the piston 120 moved uphole by the reverse fluid flow engages the floating sleeve 146 and moves the floating sleeve 146 uphole. While the external seals 126 still maintain the housing's port 118 sealed, the floating sleeve 146 shoulders against the uphole shoulder 114 in the housing 110, which prevents further uphole movement of the piston 120. Meanwhile, the slot 144 in the piston 120 does not engage the one or more releasable connections 142. The uphole-facing edge of the slot 144 is distanced from the one or more releasable connections 142 so the connections 142 are not stressed and so that premature release of the piston 120 can be avoided.

As noted previously, the releasable connection 140 can include one or more shearable members 141, such as a shear screw or a shear pin, engaged between the housing 110 and the piston 120 or can include one or more shearable members 142 and a floating sleeve 146 and slot 144 engaged with the piston 120. However, the initiator 100 can use any releasable connection, including, but not limited to an indexing collet and groove arrangement, a compressible ring and groove arrangement, a shear ring, a biasing element or compression spring, and the like.

Figure 11B:
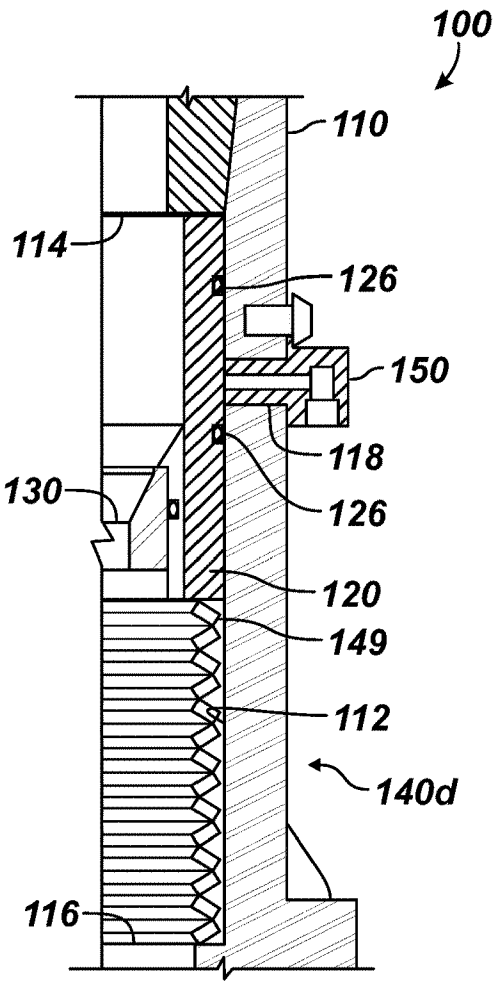
FIGS. 11A-11B illustrate cross-sectional views of initiators of the present disclosure having additional releasable connections.
Figure 11A:
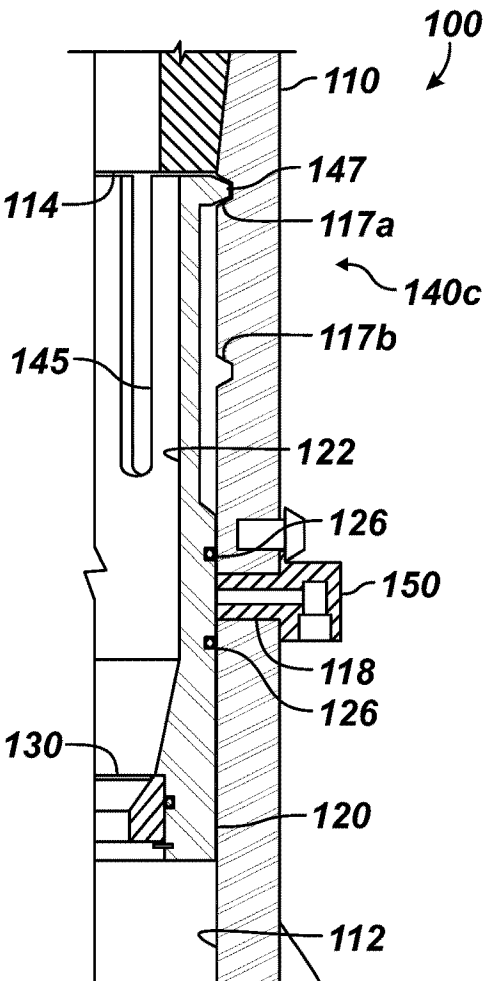

For example, FIG. 11A illustrates a cross-sectional view of an initiator 100 of the present disclosure having a different releasable connection 140*c*. Comparable reference numerals are used for comparable components to the other embodiments disclosed herein—the descriptions of which are reincorporated here. The releasable connection 140*c* includes an indexing mechanism for the piston 120 that controls movement of the piston 120 in the housing's bore 112.

In particular, the piston 120 can include collet fingers 145 with heads 147 arranged to engage in a circumferential groove 117*a* in the housing's bore 112. When fluid flow passes in a downhole direction through the piston's restriction 130, the releasable connection 140*c* has an engaged state. Here, the engagement of the heads 147 in the groove 117*a* prevents downhole movement of the piston 120 from an uphole position to a downhole position (open relative to the housing's port 118), at least until a predetermined force is produced by the fluid flow through the piston's restriction 130. Once that predetermined force is reached, the urging of the piston 120 forces the heads 147 from the groove 117*a* as the fingers 145 are bent.

However, any reverse flow in an uphole direction when the piston 120 is closed leaves the releasable connection 140*c* in an unengaged state. Here, the reverse flow will not disengage the collet fingers 145 and heads 147 from the upper groove 117*a* due to the shouldering of the collet fingers 145 against the upper shoulder 114. Should it be desired, a downhole groove 117*b* can be provided the heads 147 to engage once the piston 120 is shifted open relative to the port 118.

In another example, FIG. 11B illustrates a cross-sectional view of an initiator 100 of the present disclosure having yet a different releasable connection 140*d*. Comparable reference numerals are used for comparable components to the other embodiments disclosed herein—the descriptions of which are reincorporated here. The releasable connection 140*d* includes a biasing mechanism for the piston 120 that controls movement of the piston 120 in the housing's bore 112.

In particular, the piston 120 can biased against a biasing element 149 disposed in the housing's bore 112 between bottom end of the piston 120 and the downhole shoulder 116. The biasing element 149 can include one or more compression springs, bevel washers, or the like. Compressive load can be placed on the biasing element 149 so that the piston 120 is held in its closed position with the upper end engaged against uphole shoulder 114. When fluid flow passes in a downhole direction through the piston's restriction 130, the releasable connection 140*d* has an engaged state. Here, the bias of the biasing element 149 prevents downhole movement of the piston 120 from an uphole position to a downhole position (open relative to the housing's port 118), at least until a predetermined force is produced by the fluid flow through the piston's restriction 130. Once that predetermined force is reached, the urging of the piston 120 forces against the biasing element 149, which compresses. Any reverse flow in an uphole direction through the piston 120 in the closed state leaves the releasable connection 140*c* in an unengaged state. Here, the reverse flow will not open the piston 120 due to the shouldering of the piston 120 against the upper shoulder 114.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly for creating a sidetrack in a wellbore using a downhole tool with a whipstock, the assembly being run on a drillstring communicating fluid flow, the assembly comprising:

a milling tool configured to support the downhole tool extending therefrom, the milling tool configured to connect to the drillstring and having a mill, the milling tool defining a bore therethrough communicating the fluid flow from the drillstring to the mill, the bore having an uphole shoulder and having a port communicating the bore outside the milling tool;

a piston movable from a closed state in an uphole position toward an opened state in a downhole position in the bore, the piston having uphole and downhole ends and defining a passageway therethrough, the piston having at least one channel defined in an outer surface of the piston, the passageway defining an uphole-facing surface area exposed to the fluid flow, the piston in the uphole position closing the port from the bore, the piston moved from the uphole position toward the downhole position exposing the port to the fluid flow in the bore, the port disposed in fluid communication with the downhole tool and being configured to communicate pressure from the fluid flow in the bore to the downhole tool; and a releasable connection disposed in the at least one channel and having engaged and unengaged states with respect to an edge of the at least one channel of the piston in the closed state, the releasable connection in the engaged state being disposed in contact with the edge, the releasable connection in the unengaged state being disposed at a clearance distance from the edge, in response to a predetermined downhole force from the fluid flow in a downhole direction against the uphole-facing surface area of the piston, the releasable connection being in the engaged state disposed in contact with the edge of the at least one channel of the piston and being configured to release the piston to move from the closed state in the uphole position toward the opened state in the downhole position, and in response to an uphole force from the fluid flow in an uphole direction against the piston in the closed state, the uphole end of the piston being configured to abut the uphole shoulder of the milling tool and the releasable connection being in the unengaged state disposed at the clearance distance from the edge of the at least one channel of the piston, whereby the releasable connection is unexposed to the uphole force.

2. The assembly of claim 1, wherein the bore has a downhole shoulder therein, the port disposed between the uphole and downhole shoulders, the piston being movable from the uphole position to the downhole position having the downhole end engaged against the downhole shoulder in the bore.

3. The assembly of claim 1, wherein the milling tool comprises at least uphole and downhole housing portions, the uphole housing portion defining a portion of the bore and having a pin connection, the downhole housing portion having the mill and defining another portion of the bore, the downhole housing portion connected to the pin connection of the uphole housing portion, the pin connection defining the uphole shoulder.

4. The assembly of claim 1, wherein the assembly further comprises the downhole tool with the whipstock as part of the assembly.

5. The assembly of claim 4, wherein the downhole tool comprises:

an anchor being configured to set in the wellbore, the anchor being actuated directly or indirectly by the pressure of the fluid flow communicated by the port;

a packer being configured to set in the wellbore, the packer being actuated directly or indirectly by the pressure of the fluid flow communicated by the port; and/or a wellbore tool configured to be actuated in the wellbore, directly or indirectly by the pressure of the fluid flow communicated by the port.

6. The assembly of claim 1, further comprising a line connecting the port of the milling tool with the downhole tool and communicating the pressure from the port to the downhole tool.

7. The assembly of claim 1, wherein the piston comprises a sleeve having the passageway constricted with the uphole-facing surface area; and wherein the releasable connection is disposed between the milling tool and the sleeve.

8. The assembly of claim 7, wherein the sleeve comprises a nozzle disposed in the passageway and providing at least a portion of the uphole-facing surface area.

9. The assembly of claim 7, wherein the sleeve comprises first and second external seals engaged in the bore, the first and second external seals on the sleeve in the uphole position in the bore sealing the port from the fluid flow in the bore; and wherein the releasable connection comprises at least one shear screw disposed in a hole in the milling tool and disposed in the at least one channel defined in the outer surface, the first and second external seals on the sleeve in the downhole position in the bore sealing the hole from the fluid flow in the bore.

10. The assembly of claim 1, wherein the piston comprises a first outer surface along the uphole end, the first outer surface having a first outer diameter being less than an inner diameter of the bore of the milling tool, the first outer surface with the piston moved toward the downhole position being configured to permit the fluid flow to communicate through an annulus between the first outer diameter and the inner diameter to the port.

11. The assembly of claim 10, wherein the piston comprises a second outer surface along the downhole end, the second outer surface having a second outer diameter adjacent the inner diameter of the bore.

12. The assembly of claim 10, wherein the piston defines one or more openings in the uphole end communicating the passageway with the first outer surface.

13. The assembly of claim 1, wherein the mill defines one or more openings for communicating the fluid flow from the milling tool outside the mill; and wherein the uphole shoulder of the milling tool is configured to restrict uphole movement of the piston in response to a reverse of the fluid flow in the uphole direction from the one or more openings toward the drillstring.

14. The assembly of claim 1, wherein the releasable connection comprises at least one shear screw disposed in the milling tool, the at least one shear screw disposed in the at least one channel defined in the outer surface of the piston.

15. The assembly of claim 14, wherein the at least one shear screw is configured to contact an uphole-facing portion of the edge of the at least one channel in response to the piston urged in the downhole direction from the uphole position; and wherein the uphole end of the piston shoulders against the uphole shoulder of the bore and the at least one shear screw is disposed at the clearance distance from a downhole-facing portion of the edge of the at least one channel in response to the piston urged in the uphole direction from the uphole position.

16. A milling tool for creating a sidetrack in a wellbore, the milling tool being run on a drillstring communicating fluid flow, the tool comprising:

a mill;

a housing connected to the mill and defining a bore therethrough, the bore having an uphole shoulder therein, the bore communicating the fluid flow from the drillstring to the mill, the housing having a port communicating the bore outside the housing;

a piston movable from a closed state in an uphole position toward an open state in a downhole position in the bore of the housing, the piston having uphole and downhole ends and defining a passageway therethrough, the piston having at least one channel defined in an outer surface of the piston, the uphole end configured to abut the uphole shoulder of the housing, the passageway defining an uphole-facing surface area exposed to the fluid flow, the piston in the closed state in the uphole position closing the port from the bore, the piston moved from the uphole position toward the opened state in the downhole position exposing the port to the fluid flow in the bore, the port being configured to communicate pressure from the fluid flow in the bore outside the housing; and a releasable connection disposed in the at least one channel and temporarily holding the piston in the uphole position, the releasable connection being exposed to shear force against the edge of the at least one channel and being configured to release the piston in the closed state to move from the uphole position toward the opened state in the downhole position in response to a predetermined force from the fluid flow in a downhole direction against the exposed surface area of the piston, the uphole end of the piston in the closed state being configured to abut the uphole shoulder of the milling tool and the releasable connection being unexposed to shear force and being disposed at a clearance distance from the edge of the at least one channel in response to an uphole force from the fluid flow in an uphole direction against the piston in the closed state.

17. The milling tool of claim 16, wherein at least one shear screw of the releasable connection is configured to engage an uphole-facing portion of the edge of the at least one channel in the engaged state in response to the piston urged in the downhole direction from the uphole position; and wherein the uphole end of the piston shoulders against the uphole shoulder of the bore, and the at least one shear screw is kept at the clearance distance from a downhole-facing portion of the edge of the at least one channel in response to the piston urged in the uphole direction from the uphole position.

18. A method using fluid flow through a drillstring in a wellbore, the method comprising:

running a sidetrack assembly on the drillstring in the wellbore, the sidetrack assembly having a milling tool and a downhole tool, the milling tool having a mill and a port, the downhole tool extending downhole from the milling tool, the port disposed in fluid communication with the downhole tool;

flowing the fluid flow down the drillstring and out of the mill during run-in of the sidetrack assembly by closing off the port with a piston disposed in an uphole position in the milling tool;

preventing premature activation of the downhole tool from the communicated fluid flow by:

preventing downhole movement of the piston from a closed state in the uphole position to an opened state in a downhole position opened relative to the port using a releasable connection engaged against an edge of at least one channel on the piston, and preventing uphole movement of the piston from the closed state in the uphole position by engaging an uphole shoulder in the milling tool and keeping the releasable connection at a clearance distance from the edge of the at least one channel on the piston;

communicating the fluid flow from the port to the downhole tool by increasing the flowing of the fluid flow through the piston, releasing the releasable connection in response to a predetermined downhole force engaged with the edge of the at least one channel, and shifting the piston from the closed state in the uphole position to the opened state in the downhole position opened relative to the port; and activating the downhole tool with the fluid flow communicated from the port.

19. The method of claim 18, wherein preventing the downhole movement of the piston from the uphole position to the downhole position opened relative to the port using the releasable connection engaged against the edge of the at least one channel on the piston comprises engaging at least one shear screw of the releasable connection against an uphole-facing portion of the edge of the at least one channel in response to the piston urged in the downhole direction from the uphole position; and wherein keeping the releasable connection at the clearance distance from the edge of the at least one channel on the piston comprises shouldering the uphole end of the piston against the uphole shoulder of the bore, and keeping the at least one shear screw at the clearance distance from a downhole-facing portion of the edge of the at least one channel in response to the piston urged in the uphole direction from the uphole position.

* * * * *